United States Patent [19]

Mathis

[11] Patent Number: 4,790,789

[45] Date of Patent: Dec. 13, 1988

[54] TOY FIGURE HAVING ADJUSTABLY MOVABLE JOINTS

[76] Inventor: Michael S. Mathis, HCR 72, Box 5A, Lenorah, Tex. 79749

[21] Appl. No.: 52,918

[22] Filed: May 22, 1987

[51] Int. Cl.[4] ..... A63H 3/52; A63H 33/30

[52] U.S. Cl. ..... 446/378; 446/383; 403/90

[58] Field of Search ..... 446/378, 381, 383, 373, 446/375, 376, 377, 379, 380, 390; 403/90, 88, 92, 115, 403, 122, 119

[56] References Cited

U.S. PATENT DOCUMENTS

| | | | |
|---|---|---|---|
| 1,359,030 | 11/1920 | Cabana | 446/381 |
| 2,580,350 | 12/1951 | Friedberg | 403/90 X |
| 2,791,063 | 5/1957 | Gardel et al. | 446/380 X |
| 3,059,948 | 10/1962 | Thompson et al. | 403/90 |
| 3,197,552 | 7/1965 | Flair | 403/143 X |
| 3,265,257 | 8/1966 | Buonamici | 446/379 X |
| 3,277,602 | 10/1966 | Speers et al. | 446/380 |
| 3,470,650 | 10/1969 | Ferriot | 446/380 |
| 3,691,788 | 9/1972 | Mazziotti | 403/90 X |
| 3,940,880 | 3/1976 | Kaelin et al. | 446/381 |
| 4,673,376 | 6/1987 | Fender | 403/90 X |

FOREIGN PATENT DOCUMENTS

| | | | |
|---|---|---|---|
| 8304078 | 11/1983 | Australia | 403/90 |
| 852022 | 10/1952 | Fed. Rep. of Germany | 403/115 |
| 3302995 | 8/1984 | Fed. Rep. of Germany | 446/383 |
| 1386510 | 12/1964 | France | 446/381 |
| 235032 | 6/1925 | United Kingdom | 446/381 |

*Primary Examiner*—Robert A. Hafer
*Assistant Examiner*—D. Neal Muir
*Attorney, Agent, or Firm*—Leon Gilden

[57] ABSTRACT

A toy figure is provided with joints having adjustable mobility. Threadably movable rings provided at each joint are used to limit the degree of associated limb movement, and ball sockets are provided with integral stops to control directional movement.

1 Claim, 2 Drawing Sheets

TOY FIGURE HAVING ADJUSTABLY MOVABLE JOINTS

BACKGROUND OF THE INVENTION

1. Field of the Invention

The present invention relates to toys, and more particularly pertains to a new and improved articulated figure toy.

2. Description of the Prior Art

Articulated figure toys are well known in the prior art, and many patents have issued directed to the construction of movable joints therefor. An early example of a movable joint design is to be found in U.S. Pat. No. 1,176,209 which issued to G. Dice on Mar. 21, 1916. The Dice reference discloses a joint for use with elastic dolls and other figures wherein such joint comprises a rivet-like connector which allows relative movement between attached doll parts. No means are provided for limiting the extent or direction of such movement.

A more recent example of a toy figure having movable joints is to be found in U.S. Pat. No. 3,277,602 which issued to Speers et al on Oct. 11, 1966. This patent is directed to a toy figure having movable joints which may be frictionally maintained in any selected, manually manipulated position. This is accomplished through the use of ball joints that provide for tight frictional engagement between associated parts, as well as a complex structure of interconnected elastic braids and wires positioned interiorly of the figure. Numerous slots, threaded connectors, and through-extending pins are required to complete the construction of this doll, and accordingly, it appears that this device has met with little or no commercial success due to the high manufacturing expenses most probably associated therewith.

Accordingly, there appears to be a continuing need for new and improved toy figures which have adjustably movable joints and which could be easily and inexpensively manufactured so as to be commercially feasible. In this respect, the present invention substantially addresses this need.

SUMMARY OF THE INVENTION

In view of the foregoing disadvantages inherent in the known types of toy figures having movable joints now present in the prior art, the present invention provides an improved toy figure with movable joint capabilities wherein relative directional movement of body parts can be limited and adjustably controlled to simulate the movement of a real life person. As such, the general purpose of the present invention, which will be described subsequently in greater detail, is to provide a new and improved toy figure having adjustably movable joints which has all the advantages of the prior art movable joint toy figures and none of the disadvantages.

To attain this, the present invention relies upon molded body parts which are interconnected by frictionally engagable ball joints. The plastic ball joints are provided with selectively positioned ridges or stops to control the directional movement of limb portions in a life-like manner. Additionally, threadably movable rings are provided at the elbow, knee, neck, ankle and wrist joints, and the up and down movement of these rings control the extent of rotatable movement of the limbs in a preselected direction. In a preferred embodiment, the toy figure comprises a football basketball, hockey, player, and or pro wrestler and appropriate removable sports related clothing and gear is provided with the doll.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy figure having movable joints which has all the advantages of the prior art toy figures having movable jointss and none of the disadvantages.

It is another object of the present invention to provide a new and improved toy figure having movable joints which may be easily and efficiently manufactured and marketed.

It is a further object of the present invention to provide a new and improved toy figure having movable joints which is of a durable and reliable construction.

An even further object of the present invention is to provide a new and improved toy figure having movable joints which is susceptible of a low cost of manufacture with regard to both materials and labor, and which accordingly is then susceptible of low prices of sale to the consuming public, thereby making such toy figures having movable jointss economically available to the buying public.

Still yet another object of the present invention is to provide a new and improved toy figure having movable joints which provides in the apparatuses and methods of the prior art some of the advantages thereof, while simultaneously overcoming some of the disadvantages normally associated therewith.

Still another object of the present invention is to provide a new and improved toy figure having movable joints wherein such joints can be selectively adjusted to control the extent of rotatable movement.

Yet another object of the present invention is to provide a new and improved toy figure having movable joints wherein stops are utilized to control the directional movement of such joints.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
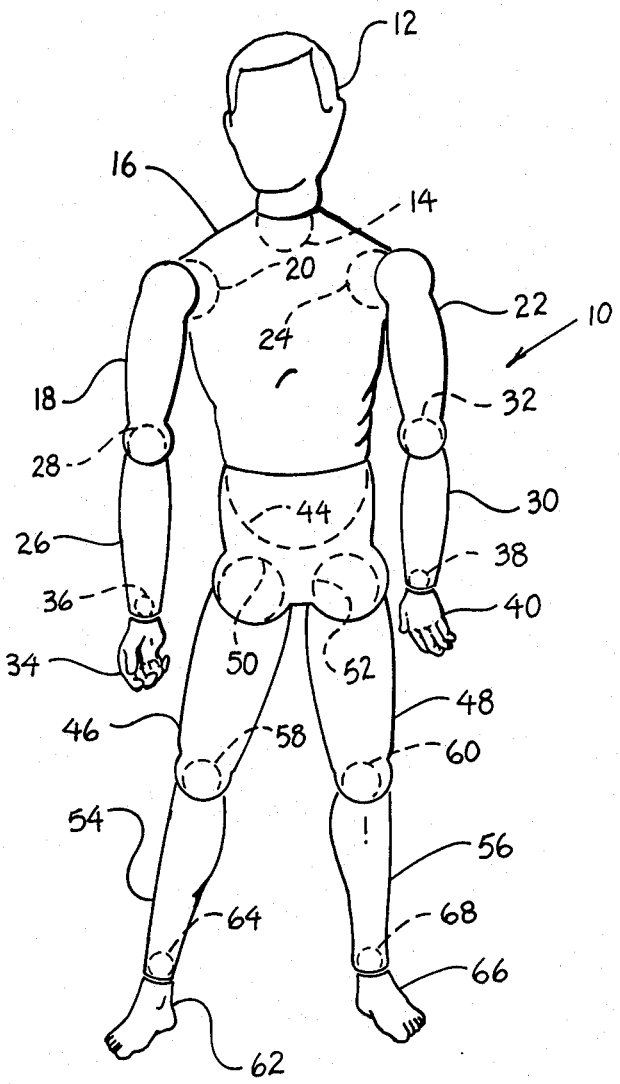
FIG. 1 is a front elevation view of a preferred embodiment of toy figure comprising the present invention.

With reference now to the drawings, and in particular to FIG. 1 thereof, a new and improved toy figure having adjustably movable parts embodying the principles and concepts of the present invention and generally designated by the reference numeral 10 will be described.

More specifically, it will be noted that the toy figure 10 is of a human-like form and is accordingly designed to employ limb movement which is substantially similar to that of a live human. The toy FIG. 10 includes a head 12 connected by a swivelable ball joint 14 to an upper torso 16. A right upper arm 18 is connected by a ball joint 20 to the torso 16, and a left upper arm 22 is similarly connected to the torso by a ball joint 24. A lower right arm 26 is connected to the upper arm 18 by a ball joint 28, and a lower left arm 30 is connected to the upper arm 22 by a further ball joint 32. The lower right arm 26 has a hand 34 connected thereto by a swivelable ball joint 36. Similarly, a ball joint 38 connects the left hand 40 to the lower arm 30.

The further movable components of the toy FIG. 10 include a lower torso 42 connected to the upper torso 16 by a swivelable ball joint 44. Right and left upper legs 46, 48 are attached to the lower torso 42 by respective ball joints 50, 52. Lower right and left leg sections 54, 56 are respectively attached to the upper leg sections 46, 48 by respective ball joints 58, 60. A right foot 62 is connected to the lower left leg 54 by a ball joint 64, and a left foot 66 is connected to the lower leg 56 by a further ball joint 68.

Figure 2:
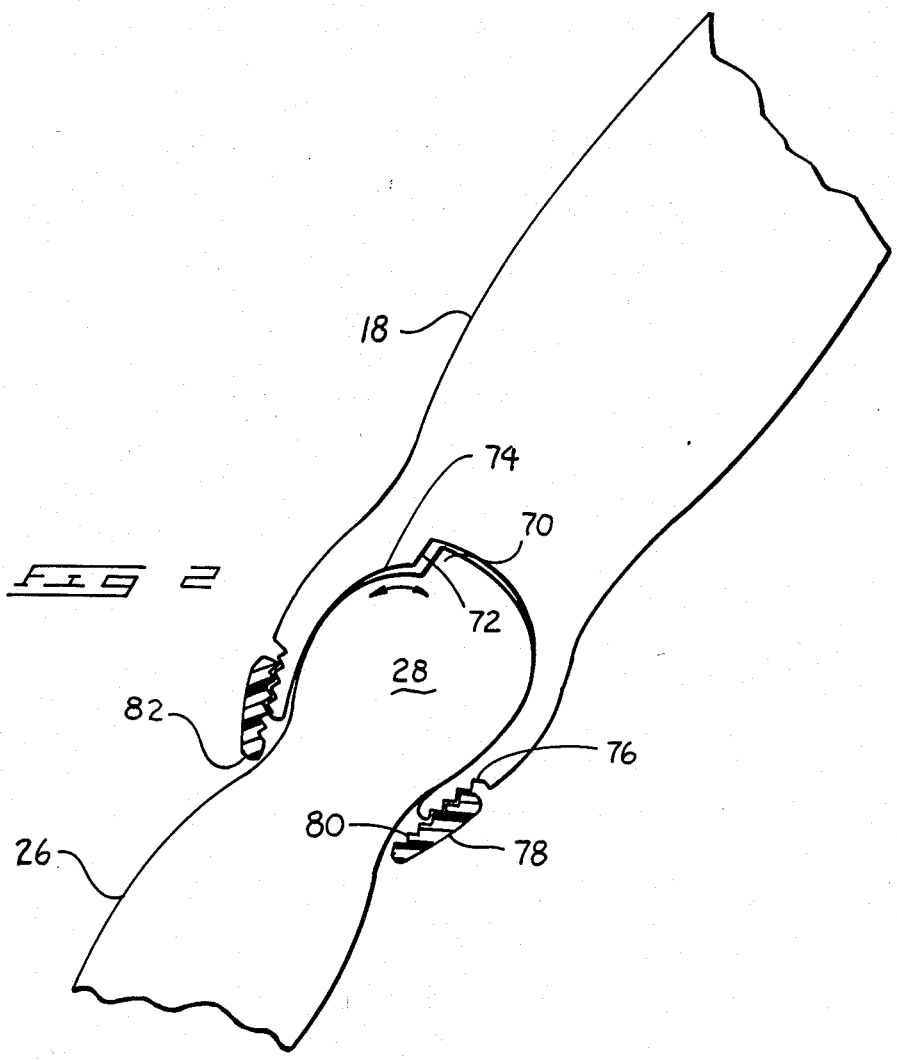
FIG. 2 is a partial detail view, partly in cross section, illustrating the adjustment mechanism associated with the present invention.

As can be appreciated, if any of the various movable body components of the toy FIG. 10 move to a greater extent or in a direction which is different from that of a real life human, the realism associated with the doll will be diminished. The present invention 10 addresses this problem by controlling the direction of movement of relatively movable body parts and also the extent of movement in a selected direction. To understand the manner of accomplishing this result, reference is made to FIG. 2 of the drawings which illustrates a typical joint interconnection assembly.

As shown, the upper arm 18 is connected to the lower arm 26 by ball joint 28. Since the ball joint 28 represents an elbow connection on the doll 10, it can be appreciated that the forearm 26 should not move rearwardly relative to the upper arm 18, thus to simulate life-like movement. To achieve this, the molded ball joint 28 is provided with an upstanding stop 70 which is selectively abuttable against a wall portion 72 integrally molded within the socket opening 74 forming a part of the upper arm 18. In the drawing, it is apparent that clockwise rotatable movement of the forearm 26 relative to the upper arm 18 is permitted, while only limited counterclockwise movement can be experienced. Similar stops are employed in all relevant joints, e.g., at the joint connections of the wrist, ankles, knees, neck and torso sections.

As to controlling the extent of rotational movement of particular ball joints within a socket, thus to simulate the physical conditioning and flexibility of a human being, reference is again made to FIG. 2 of the drawings. As illustrated, the upper arm 18 may be provided with a lower externally threaded portion 76 which extends completely around the arm section and which lies proximate to the ball receiving socket 74. A circular adjustment ring 78 includes internal threads 80 which are threadably engagable with the external threads 76. This ring member 78 may be threadably moved upwardly and downwardly relative to the upper arm 18, and a lower lip portion 82 is selectively abuttable against the forearm 26 in response to a rotatable movement thereof within the socket 74. When the ring member 78 is in a downwardly extending position, the forearm 26 will be afforded only limited rotational movement within the socket 74 due to its abutment with the lip 82. If additional movement and flexibility is desired, a user can threadably move the ring member 78 upwardly on the threads 76, thus to increase the range of permitted rotational movement of the forearm 26. This rotational adjustment mechanism can be provided on any or all of the associated joints forming a part of the doll 10.

As to the manner of usage and operation of the present invention, the same should be apparent from the above description. Accordingly, no further description thereof will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved toy figure having adjustably movable joints, said figure comprising:

a body portion having a plurality of relatively movable first and second body parts attached thereto by ball joint means;

directional movement control means for controlling a direction of rotational movement between said body parts; and adjustable rotational movement control means for controlling an extent of rotational movement between said body parts in said established movement direction, and wherein said directional movement control means comprises a stop member formed on a ball of said ball joint means, and wherein said directional movement control means comprises a wall portion integrally formed on a socket of said ball joint means;

said directional movement control means comprises said stop member formed on said ball being abut-table against said wall portion of said socket which receives said ball, wherein said adjustable rotational movement control means comprises an internally threaded conical ring member threadedly connected to and of limited adjustment relative to said socket of a first body part between said relatively movable body parts, said ring member surroundingly overlying a second body part to provide an abutment lip means to enable only limited rotation of said second body part relative to said first body part.

* * * * *